US005887323A

United States Patent [19]

Beifuss et al.

[11] Patent Number: 5,887,323

[45] Date of Patent: Mar. 30, 1999

[54] APPARATUS AND METHOD FOR THE PRODUCTION OF A MULTICOMPONENT YARN

[75] Inventors: Horst Beifuss, Wermelskirchen; Klaus Gerhards, Hückeswagen, both of Germany

[73] Assignee: Barmag AG, Remscheid, Germany

[21] Appl. No.: 976,202

[22] Filed: Nov. 21, 1997

[30] Foreign Application Priority Data

Nov. 21, 1996 [DE] Germany ..... 196 48 167.8

[51] Int. Cl.[6] ..... D05G 1/12

[52] U.S. Cl. ..... 28/221; 28/246; 28/255

[58] Field of Search ..... 28/220, 221, 240, 28/245, 246, 247, 254, 256, 258; 264/210.8, 177.17, 210.7, 211.14

[56] References Cited

U.S. PATENT DOCUMENTS

| | | | |
|---|---|---|---|
| 2,942,325 | 6/1960 | Spellman | 28/221 |
| 3,099,064 | 7/1963 | Haynes | 28/221 |
| 4,118,843 | 10/1978 | Schippers et al. | 28/258 |
| 4,153,660 | 5/1979 | Reese | 28/220 |
| 5,251,363 | 10/1993 | Gerhards et al. | 28/221 |

FOREIGN PATENT DOCUMENTS

| | | |
|---|---|---|
| 0 133 198 | of 0000 | European Pat. Off. . |
| 42 02 896 | of 0000 | Germany . |

*Primary Examiner*—Michael A. Neas
*Assistant Examiner*—Larry D. Worrell, Jr.
*Attorney, Agent, or Firm*—Bell Seltzer Intellectual Property Law Group of Alston & Bird LLP

[57] ABSTRACT

An apparatus and method for the production of a multicomponent yarn which is composed of several multifilament strands with differing characteristics, such as color. The individual strands are drawn in parallel and simultaneously by a pair of godets following spinning, and then crimped by compression in an air jet crimping device. According to the invention, the individual strands are spread apart from one another prior to run-off from the drawing godet in such a way that the distance in the axial direction between the run-off points of the individual strands on the godet surface is increased. This spreading of the strands assures that the strands do not intermix prior to entering the air jet crimping device.

11 Claims, 4 Drawing Sheets

APPARATUS AND METHOD FOR THE PRODUCTION OF A MULTICOMPONENT YARN

BACKGROUND OF THE INVENTION

The present invention relates to an apparatus and method for the production of a multicomponent yarn.

In the production of multicomponent yarns, particularly multicolored multicomponent yarns which are produced by the mixing of several individual strands of different colors, the individual strands are mixed in a texturing jet. In such case, the individual strands are crimped in a compression chamber by means of air jets which impinge upon the strands at an angle as they pass through. The problem in this case is that of achieving a mixing of the individual strands which does not result in either a predominance of an individual strand or an incomplete mixing of the individual strands in the resulting multicomponent yarn. The objective of the compression crimping is to achieve a good crimping with a uniform and reproducible color pattern of the multicomponent yarn.

To solve the problem, it has been proposed, in DE 42 02 896, to subject the individual strands to a false twist before they are fed into the texturing jet. There is, however, a risk in this case of the individual strands being too evident in the multicomponent yarn and, furthermore, of the crimping effect being reduced.

EP 0 133 198 discloses a method in which, prior to their entry into the texturing jet, the individual strands are routed back and forth in order to change their positions relative to each other. In this case, the filaments of the individual strands undergo a high degree of intermixing. Consequently, the multicomponent yarn is frequently of a mixed color rather than being truly multicolored.

It is accordingly an object of the present invention to improve the method of the type initially referred to in such a way that the multicomponent yarn has a uniform and reproducible color pattern without reduction of the quality of the crimping.

SUMMARY OF THE INVENTION

The above and other objects and advantages of the present invention are achieved by the provision of an apparatus and method which comprises a plurality of spinnerets for spinning respective multifilament strands which have differing characteristics and so that the strands advance downwardly from respective spinnerets in a laterally spaced apart arrangement. The advancing multifilament strands are drawn while the strands advance downwardly in a laterally spaced apart parallel relationship, and the drawing system includes an upstream godet and a downstream godet over which the strands are guided. A strand spreading device is provided for laterally spreading apart the individual strands so that the lateral distance between the individual strands is increased at the point the strands run off the downstream godet.

An air jet crimping device is positioned downstream of the drawing godets for combining the advancing strands to form a composite yarn and compressing the composite yarn to form a yarn plug, and a winder withdraws the crimped composite yarn from the yarn plug and winds the same into a package.

The invention is based on the discovery that the run-off of the strands from the downstream drawing godet which precedes the texturing jet, significantly influences the mixing of the individual strands in the texturing jet. It has been shown that, due to the different characteristics of the individual strands, the run-off point on the surface of the godet varies. The run-off point of each individual strand is the point at which the strand separates from the surface of the godet in running off the godet. Depending on how the individual strand has been prepared or on its color, different adhesion forces are produced between the strand and the surface of the godet. These adhesion forces cause the individual strand to adhere to the surface of the godet and, as a consequence, not to separate directly in the geometric separation point. The geometric separation point here is the same as the point of contact between the surface of the godet and the strand running in a tangential plane. The result of this differing run-off behavior is that the individual strands can become wound around the surface of the godet to a greater or lesser extent, so that they come into contact even before entry into the texturing jet and their filaments are mixed. Such mixing situations occur particularly in those cases in which the individual strands are drawn off obliquely from the surface of the godet and guided to the texturing jet.

According to the invention, therefore, the individual strands are spread out from one another prior to run-off from the downstream drawing godet in such a way that the distance between the strands is increased. This prevents a mixing of the individual strands occurring prior to entry into the texturing jet. Surprisingly, it has been possible to produce a very uniform, clear color pattern in the multicomponent yarn by this construction.

In installations where the downstream drawing godet has an adjacent cooperating over-run roller, with the advancing strands being wound about the downstream godet and the over-run roller, several times, it is preferable to position the spreading device so as to engage the final winding. This offers the advantage that the invention is adapted for use with conventional structural arrangements.

The invention can also be easily realized by inserting several thread guides into the course of the individual strands.

Particularly in those cases in which several multicomponent strands are produced simultaneously and adjacently parallel in one machine, it is necessary for the individual strands of the outer multicomponent strands to be guided obliquely from the downstream godet to the texturing jet. According to the invention, the method can be expanded in such a way that, in particular, a spread is maintained between the individual strands of the outer multicomponent threads.

This spread of the individual strands is advantageously adjusted in dependence on the offset between the run-off point on the godet and the texturing jet. In general, the greater the offset, the greater should be the distance between the individual strands.

BRIEF DESCRIPTION OF THE DRAWINGS

The following drawings describe parts of the device for the application of the method according to the invention, wherein.

DETAILED DESCRIPTION OF THE PREFERRED EMBODIMENT

Figure 1:
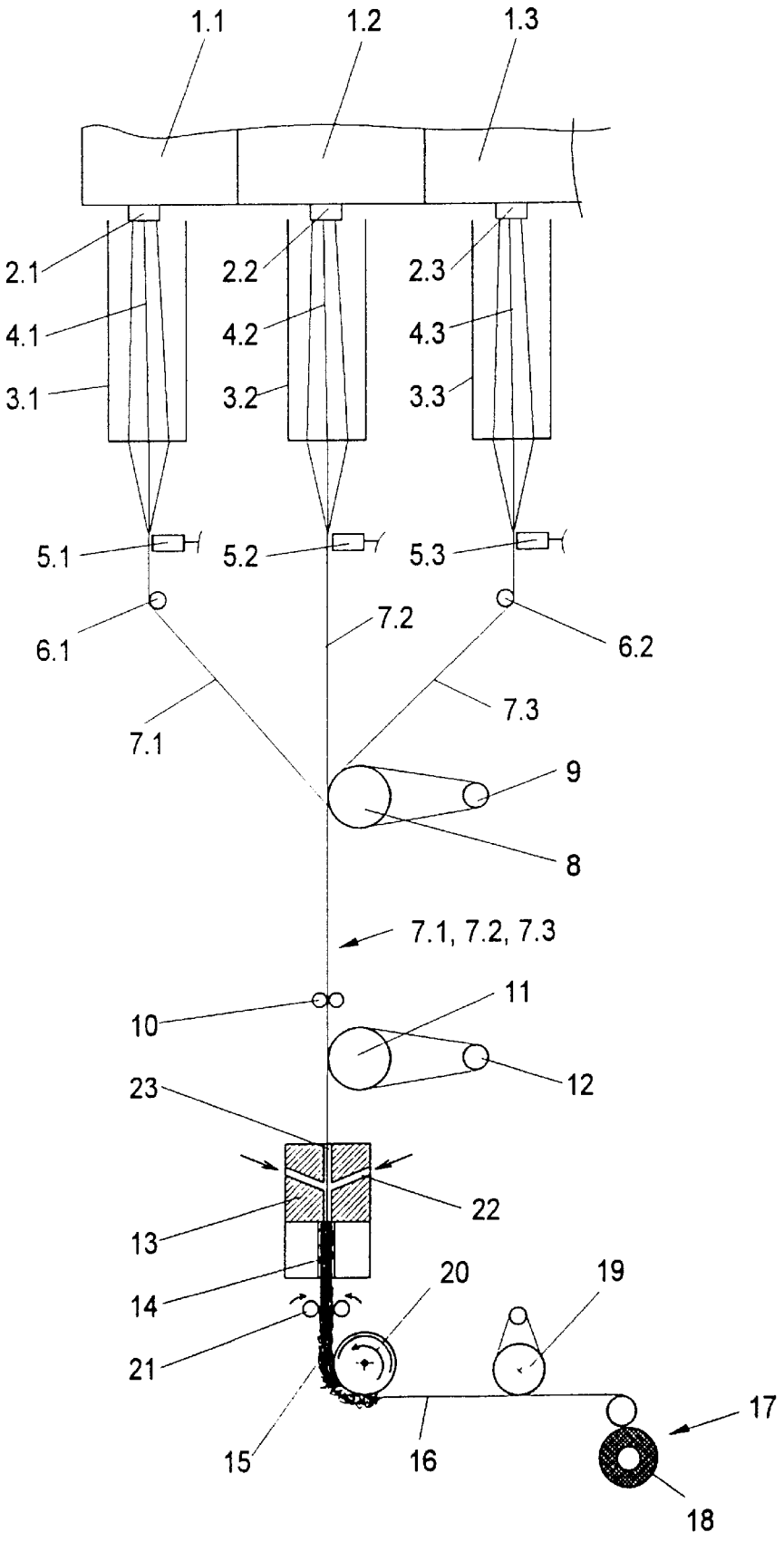
FIG. 1 shows, schematically, a spinning machine for the production of a multicomponent yarn in accordance with the present invention.

FIG. 1 shows a spinning machine for the production of a multicomponent yarn. In this spinning machine, three different feeds of a thermoplastic polymer are melted in the spinning locations 1.1, 1.2 and 1.3 and, by means of the spinnerets 2.1, 2.2 and 2.3, extruded and spun as thin, endless filament bundles. Each of the feeds is of a different color. The filament bundles 4.1, 4.2, 4.3 are then each cooled in a cooling shaft 3, after which they are guided into a common running plane. In this running plane there is a preparation device 5, through which the filaments are passed. Here, the individual filaments are provided with a preparation agent. Each filament bundle is combined to produce one single strand 7.1, 7.2 and 7.3. The individual strands 7.1, 7.2 and 7.3 each have dye colorations which differ from each other. The individual strands 7.1, 7.2 and 7.3 are then guided together, but still separate from one another and substantially in parallel to one another, onto the upstream godet 8 of the drawing system. The individual strands wind several times around the godet 8 and the over-run roller 9. The individual strands are heated by the godet 8 and stretched and drawn off by the drawing godet 11.

Disposed before the drawing godet 11 is a strand spreader 10 which spreads the parallel course of the individual strands so that the distances between the individual strands 7.1, 7.2 and 7.3 are increased. After the individual strands have run off the drawing godet 11, the individual strands are together guided into a subsequent texturing jet 13, or stuffer box. Here, the individual strands 7.1, 7.2 and 7.3 together enter the yarn channel 23 of the texturing jet 13. In the yarn channel 23, the individual strands are combined to form a resulting bundle, i.e., a multicomponent yarn 16. For this purpose, the yarn channel is connected to a compressed air source via an air delivery channel 22. This compressed air is blown into the yarn channel 23 at an acute angle so that the individual strands are drawn off from the godet 11 and delivered in the air jet at high speed. The compressed air is heated so that the intermingled yarn bundle is also heated. The yarn channel 23 opens into a compression chamber 14 whose walls have lateral outlet openings for the air. In the compression chamber 14, the multicomponent yarn 16 is then piled up to form a plug 15, the delivered yarn impacting on the surface of the plug. By this means, the individual filaments are crimped by the formation of arcs and similar curves. At the same time, the yarn plug is compressed by the pressure of the inflowing air and slowly forced out of the compression chamber. The compression intensifies the crimping.

When the plug 15 emerges from the compression chamber 14 the lateral openings are cleared so that the air can escape from the compression chamber. A certain filling level, dependent on the constant speed of the draw-off rollers 21, ensues in the compression chamber. The yarn plug emerging from the compression chamber is delivered by the draw-off rollers 21 to the cooling drum 20. It is then laid on the porous outer casing of the rotating cooling drum 20. A negative pressure is produced in the cooling drum and by this means an ambient air current is passed through the yarn plug 15 laid on the porous circumference. The yarn is then drawn out of the yarn plug 15, as a multicomponent yarn 16, by the draw-off godet 19 and guided to the winding device 17. The yarn is then wound to form a package 18.

Figure 2:
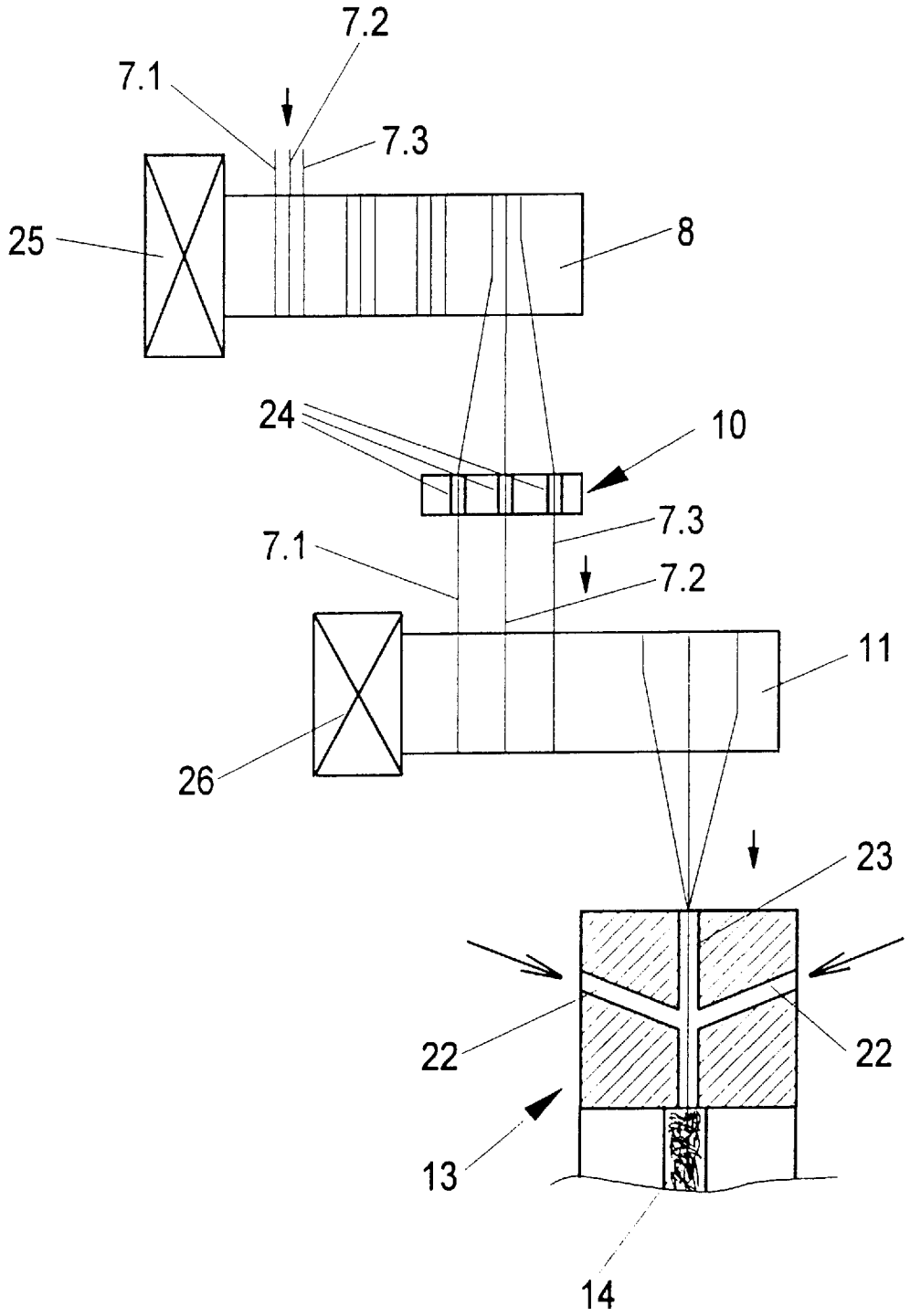
FIG. 2 shows the upstream and downstream drawing godets, and the texturing jet as seen in FIG. 1.

FIG. 2 shows a side view of the drawing godets with a subsequent texturing jet from FIG. 1. To this extent, reference is made to the description relating to FIG. 1. Here, the individual strands 7.1, 7.2 and 7.3 pass to the upstream godet 8, which is driven at a controlled speed by the godet drive 25. Following run-off from the godet 8, the individual strands pass to the strand spreading device 10, which comprises the strand guides 24 which are disposed in relation to one another in such a way that the distance between the individual strands 7.1 and 7.2 and between the individual strands 7.2 and 7.3 is increased. The individual strands then run onto the downstream drawing godet 11, which is driven at a controlled speed by the drive 26. From the drawing godet 11, the individual strands are guided to the texturing jet 13. In this arrangement, the strands are spread between the two godets.

Figure 3:
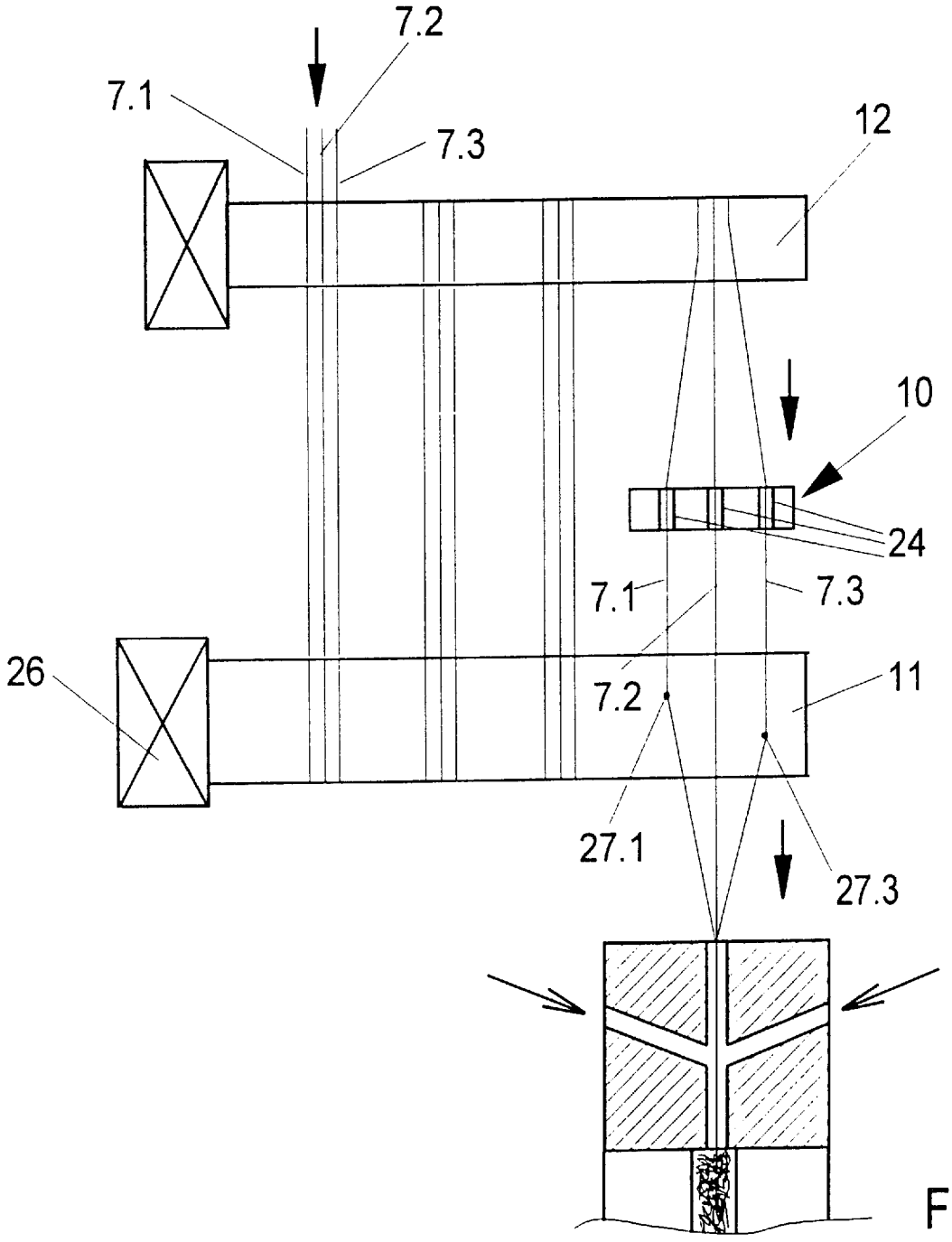
FIG. 3 illustrates a multiply wound godet with a preceding thread spreading device.

In contrast, FIG. 3 shows an arrangement in which the strand spreading device 10 is disposed in the final winding of the downstream drawing godet 11. For this purpose, the strand guides 24 of the strand spreading device 10 are mounted in the strand course between the over-run roller 12 and the godet 11. By this means, the distances between the individual strands are increased shortly prior to run-off from the godet 11, so that the differing separation behavior of the individual strands from the surface of the godet cannot negatively affect the subsequent crimping and mixing process in the texturing jet. The individual strand 7.1 separates from the surface of the godet 11 as early as the run-off point 27.1. The individual strand 7.3 separates from the godet surface only at the late run-off point 27.3.

Figure 4:
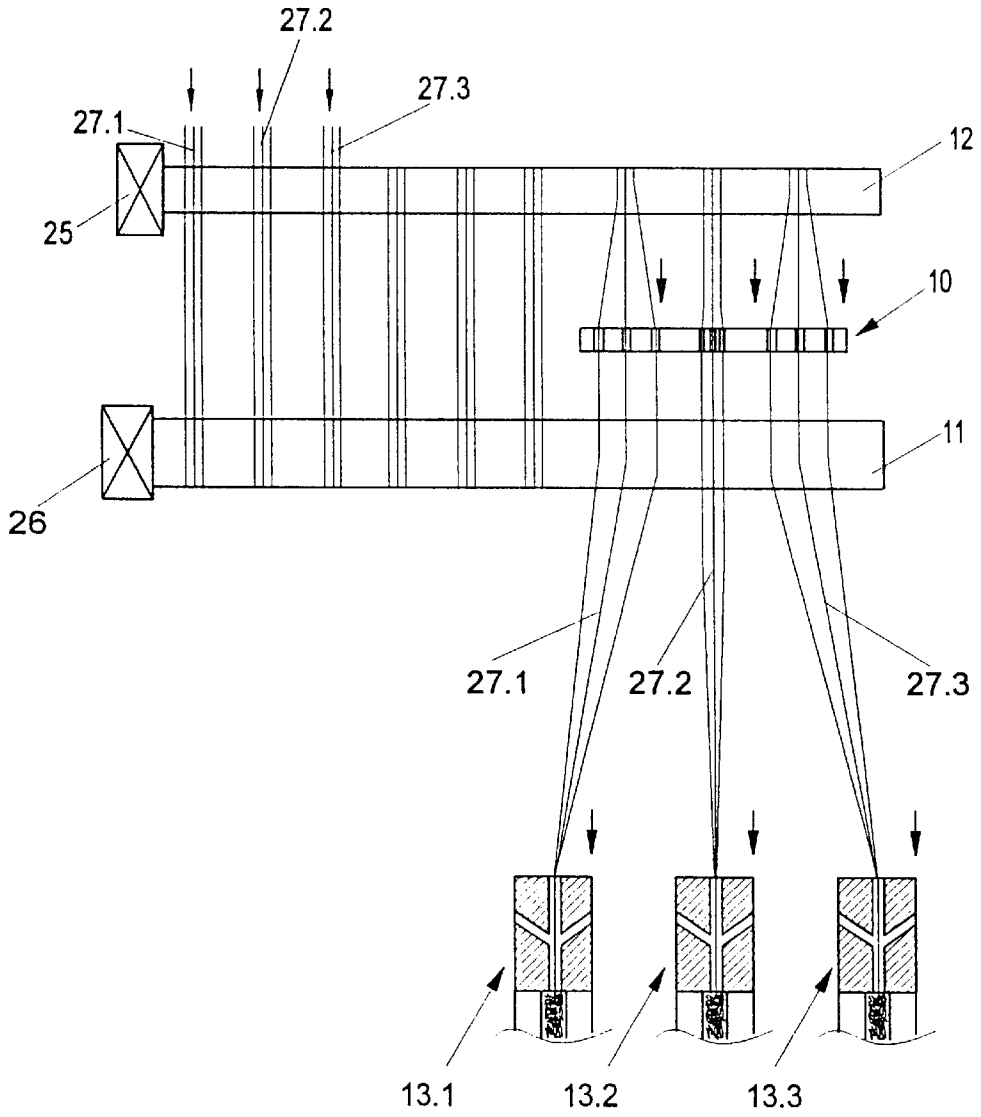
FIG. 4 shows, schematically, a godet and texturing jet arrangement for the production of several multicomponent yarns.

The method is particularly suitable for spinning machines in which several multicomponent yarns are produced simultaneously and adjacently parallel to one another. As shown in FIG. 4, due to the adjacently parallel disposition of the texturing jets 13.1, 13.2 and 13.3 in one plane, the outer individual strands 27.1 and 27.3 are drawn off from the godet 11 and enter the texturing jet 13.1 and 13.3 obliquely. In this case, likewise, as already shown in FIG. 3, the strand spreading device 10 is disposed in the thread course of the final winding between the over-run roller 12 and the godet 11. The strand guides 24 increase the distances between the individual strands so that the differing separation behaviors of the individual strands from the godet surface, particularly in the case of oblique draw-off from the godet, do not result in the filaments of the individual strands becoming mixed prior to entry into the texturing jet.

In this case, the central single strand 27.2 is spread to a lesser extent than the individual strand bundles 27.1 and 27.3 which are drawn off obliquely from the godet.

In the drawings and specification, there has been set forth a preferred embodiment of the invention, and although specific terms are employed, they are used in a generic and descriptive sense only and not for purposes of limitation.

That which is claimed is:

1. An apparatus for producing a multifilament yarn which is composed of several multifilament strands which have differing characteristics, comprising a plurality of spinnerets for spinning respective multifilament strands with differing characteristics and so that the strands advance downwardly from respective spinnerets in a laterally spaced apart arrangement, means for drawing the advancing multifilament strands while the strands advance in a laterally spaced apart parallel relationship and including an upstream godet and a downstream godet over which the strands are guided, and a strand spreading device for laterally spreading apart the individual strands so that the lateral distance between the individual strands is increased at the point the strands run off the downstream godet, air jet crimping means positioned downstream of the drawing means for combining the advancing strands to form a composite yarn and compressing the composite yarn to form a plug of crimped yarn, and winding means for withdrawing the crimped composite yarn from the yarn plug and winding the same into a package.

2. The apparatus as defined in claim 1 wherein said strand spreading device is positioned between the upstream and downstream godets so as to engage the strands as they pass therebetween.

3. The apparatus as defined in claim 1 wherein said drawing means further comprises an over-run roller disposed generally parallel to and adjacent said downstream godet, and such that the advancing multifilament strands may be wound several times collectively about the over-run roller and the downstream godet, and wherein the strand spreading device is positioned between the over-run roller and the downstream godet and so as to engage the final winding of the advancing strands.

4. An apparatus for simultaneously producing a plurality of multifilament yarns which are each composed of several multifilament individual strands which have differing characteristics, comprising a plurality of spinnerets for spinning a plurality of sets of multifilament strands, with the strands of each set having differing characteristics, and so that the strands of each set advance downwardly from respective spinnerets in a laterally spaced apart arrangement and with the sets being laterally spaced apart, means for drawing the advancing sets of multifilament strands while the strands and the sets advance in a laterally spaced apart parallel relationship and including an upstream godet and a downstream godet over which the sets of strands are guided, and a strand spreading device for laterally spreading apart the individual strands of at least one set so that the lateral distance between the individual strands of such one set is increased at the point the strands run off the downstream godet, air jet crimping means positioned downstream of the drawing means for combining the advancing strands of each set to form a composite yarn and compressing the composite yarn to form a plug of crimped yarn, and winding means for withdrawing the crimped composite yarn from each yarn plug and winding the same into a package.

5. The apparatus as defined in claim 4 wherein said drawing means further comprises an over-run roller disposed generally parallel to and adjacent said downstream godet, and such that the advancing sets of multifilament strands may be wound several times collectively about the over-run roller and the downstream godet, and wherein the strand spreading device is positioned between the over-run roller and the downstream godet and so as to engage the final winding of the sets of advancing strands.

6. The apparatus as defined in claim 5 wherein the strand spreading device is configured for laterally spreading the strands of at least one set to a degree greater than the strands of another set.

7. The apparatus as defined in claim 4 wherein sufficient spinnerets are provided for spinning at least three sets of multifilament strands, and wherein said air jet crimping means comprises at least three separate air jet crimping devices positioned adjacent the downstream drawing godet and aligned along a direction parallel to the axis of the downstream drawing godet, and wherein the sets of strands are directed to respective ones of the air jet crimping devices from the downstream drawing godet.

8. The apparatus as defined in claim 7 wherein the air jet crimping devices are positioned so that at least one of the sets of strands is laterally deflected as it runs off the surface of the downstream drawing godet, while the direction of advance of at least one other set is maintained without significant lateral deflection.

9. A method for producing a multifilament yarn which is composed of several multifilament strands which have differing characteristics, comprising the steps of spinning a plurality of multifilament strands which have differing characteristics from each other and so that the strands advance downwardly in a laterally spaced apart arrangement, drawing the downwardly advancing multifilament strands while the strands advance in a laterally spaced apart parallel relationship and including guiding the strands serially over an upstream godet and a downstream godet and including laterally spreading apart the individual strands so that the lateral distance between the individual strands is increased at the point the strands run off the downstream godet, combining the advancing strands at a location downstream of the downstream godet to form a composite yarn and then compressing the composite yarn to form a plug of crimped yarn, and withdrawing the crimped composite yarn from the yarn plug and winding the same into a package.

10. The method as defined in claim 9 wherein the differing characteristics of the several strands include being of differing colors.

11. The method as defined in claim 9 wherein the step of compressing the composite yarn includes subjecting the composite yarn to a heated fluid in a stuffer box.

* * * * *